US011181071B2

(12) United States Patent
Dirumdam et al.

(10) Patent No.: US 11,181,071 B2
(45) Date of Patent: Nov. 23, 2021

(54) INTERNAL COMBUSTION ENGINE

(71) Applicant: MAN Energy Solutions SE, Augsburg (DE)

(72) Inventors: Björn Dirumdam, Ellgau (DE); Johannes Ruschkowski, Augsburg (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 17/009,192

(22) Filed: Sep. 1, 2020

(65) Prior Publication Data

US 2021/0087998 A1 Mar. 25, 2021

(30) Foreign Application Priority Data

Sep. 4, 2019 (DE) ..... 10 2019 123 721.1

(51) Int. Cl.

| | |
|---|---|
| ***F02F 7/00*** | (2006.01) |
| ***F02P 3/02*** | (2006.01) |
| ***F02P 15/00*** | (2006.01) |
| *H01T 13/04* | (2006.01) |

(52) U.S. Cl.

CPC ..... *F02F 7/006* (2013.01); *F02P 3/02* (2013.01); *F02P 15/001* (2013.01); *F02P 15/006* (2013.01); *H01T 13/04* (2013.01)

(58) Field of Classification Search

CPC ..... F02F 7/0031; F02F 7/0024; F02F 1/242; F02P 3/02; F02P 13/00; H01T 13/04; H01T 13/08

See application file for complete search history.

(56) References Cited

U.S. PATENT DOCUMENTS 3,941,115 A * 3/1976 Tshida ..... F02F 7/006 123/198 E
2002/0162545 A1* 11/2002 Weingaertner ..... F02F 7/006 123/647

FOREIGN PATENT DOCUMENTS

CH 713504 A1 * 8/2018 ..... H01T 13/08
DE 102012208076 11/2013
DE 102012023836 6/2014
EP 0449725 A1 * 10/1991 ..... H01R 13/6271

* cited by examiner

*Primary Examiner* — Michael A Kessler
(74) *Attorney, Agent, or Firm* — Cozen O'Connor

(57) ABSTRACT

An internal combustion engine having at least one cylinder bank comprising multiple cylinders, each cylinder comprises a rocker arm box for accommodating rocker arms of a valve train, and each cylinder comprises a rocker arm cover pivotable relative to the rocker arm box. The rocker arm cover carries an ignition coil contactable with a spark plug via an extension extending through a protective tube between the cylinder head and the rocker arm box or the rocker arm cover. The rocker arm cover comprises a first portion with a first introduction aid, into which the protective tube is threaded during closure of the rocker arm cover and a second portion with a second introduction aid, into which the spark plug extension is threaded during closure of the rocker arm cover to automatically and self-centringly form an electrical contact between the spark plug extension and the ignition coil.

6 Claims, 3 Drawing Sheets

INTERNAL COMBUSTION ENGINE

BACKGROUND OF INVENTION

1. Field of the Invention

The invention relates to an internal combustion engine. The invention relates in particular to so-called large engines or large internal combustion engines, the cylinders of which have a piston diameter of more than 140 mm, in particular of more than 175 mm. Such large internal combustion engines are for example marine engines or stationary engines.

2. Description of Related Art

From DE 10 2012 023 836 A1 an internal combustion engine having multiple cylinders is known. The internal combustion engine comprises a cylinder crankcase in which a crankshaft is mounted. The cylinders form at least one cylinder bank. Each cylinder comprises a cylinder head and a rocker arm box positioned above the cylinder head, wherein the rocker arm box serves for accommodating rocker arms of a valve train.

From DE 10 2012 208 076 A1 a further internal combustion engine is known. From this it is known that above the rocker arm box positioned above the cylinder head a cover is positioned, which closes off the rocker arm box at the top. This cover can be removed to expose access to an interior of the rocker arm box.

In the case of internal combustion engines with spark plugs, i.e. in which a fuel to be combusted is ignited via a spark plug, access to the rocker arm box by removing a cover or a rocker arm cover requires major effort.

Accordingly, electrical contacts of an ignition coil, which is contacted in an electrically conductive manner with the spark plug of the respective cylinder, have to be elaborately disconnected for this purpose. Following this, these electrical contacts have to be elaborately plugged in again. This is disadvantageous.

SUMMARY OF THE INVENTION

There is therefore a need on an internal combustion engine, in which the access to the rocker arm box or assemblies positioned in the rocker arm box, in particular for performing maintenance operations, is simplified. One aspect of the invention is a new type of internal combustion engine.

Each cylinder of the internal combustion engine comprises a rocker arm box for accommodating rocker arms of a valve train for the gas exchange valves and a rocker arm cover, which is pivotable relative to the respective rocker arm box.

The respective rocker arm cover of the internal combustion engine carries an ignition coil for the spark plug of the respective cylinder, which is contactable with the spark plug via a spark plug extension extending through a protective tube between the cylinder head and the rocker arm box or the rocker arm cover of the respective cylinder.

In the internal combustion engine according to one aspect of the invention, the rocker arm cover comprises a first portion with a first introduction aid, into which the protective tube is threaded during the pivoting closure of the rocker arm cover. Furthermore, the rocker arm cover comprises a second portion having a second introduction aid into which an end of the spark plug extension protruding from the protective tube is threaded during the pivoting closure of the rocker arm cover, in order to automatically and self-centringly form an electrical contact between the spark plug extension and the ignition coil of the respective cylinder.

Through the configuration of the internal combustion engine according to one aspect of the invention, a simplified access to the rocker arm box and to assemblies positioned in the rocker arm box is possible. Only the rocker arm cover has to be pivoted relative to the rocker arm box. By way of introduction aids of the rocker arm cover for the protective tube and the end of the spark plug extension protruding from the protective tube an automatic and self-centring contacting between the spark plug extension and the ignition coil and thus between the spark plug and the ignition coil is possible.

Elaborate disconnecting and plugging electrical contacts in the high-voltage path between the spark plug and the ignition coil, such as is required in internal combustion engines known from practice, can thus fall away.

According to an advantageous further development, an end of the spark plug extension protruding from the protective tube is guided in a plug, which during the closing of the rocker arm cover is threaded into the first introduction aid. The end of the spark plug extension protruding from the plug is threaded into the second introduction aid during the closure of the rocker arm cover. By way of this, the automatic, self-centring contacting between the spark plug extension and the ignition coil can be particularly advantageously provided.

According to an advantageous further development, the second portion with the second introduction aid is arranged within a region delimited by the first portion with the first introduction aid. This further development of the invention also serves for the particularly advantageous provision of the automatic, self-centring contacting between the spark plug extension and the ignition coil of the receptive cylinder.

According to an advantageous further development, the second portion forms an electrical plug contact for the end of the spark plug extension protruding from the protective tube. This further development also allows providing the automatic, self-centring contacting between the spark plug extension and the ignition coil in a particularly advantageous manner.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

The invention relates to an internal combustion engine.

The internal combustion engine is a so-called large engine or a large internal combustion engine having a piston diameter of more than 140 mm, in particular of more than 175 mm. Such large engines are employed as drive units on ships or in power stations for power generation.

An internal combustion engine comprises a cylinder crankcase in which a crankshaft is mounted. Furthermore, an internal combustion engine comprises multiple cylinders that form at least one cylinder bank. In particular when all cylinders are positioned in series, the same form a cylinder bank. In particular when the cylinders are grouped in V-design, the cylinders form two cylinder banks.

Each cylinder comprises inlet-side gas exchange valves and exhaust-side gas exchange valves, which are received in a cylinder head of a respective cylinder.

Furthermore, a spark plug is accommodated in the respective cylinder head which serves for igniting a fuel to be combusted in the respective cylinder of the internal combustion engine.

For actuating the gas exchange valves of the cylinders of an internal combustion engine, the internal combustion engine comprises a valve train, wherein the valve train for the gas exchange valves of each cylinder comprises rocker arms, which are accommodated in a rocker arm box of the respective cylinder.

Figure 1:
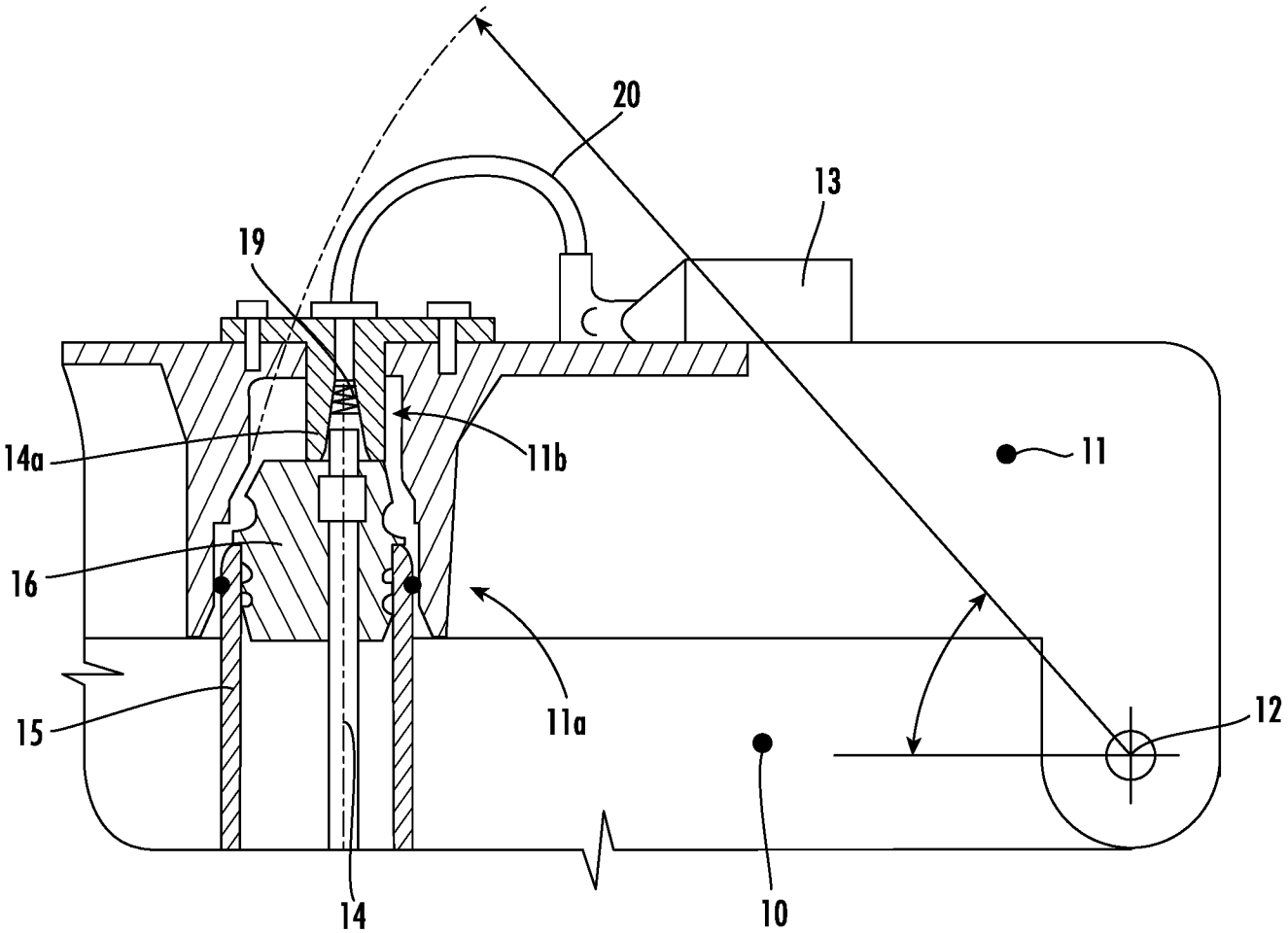
FIG. 1 is an extract from an internal combustion engine according to the invention in the region of a rocker arm box and a rocker arm cover with closed rocker arm cover.
Figure 2:
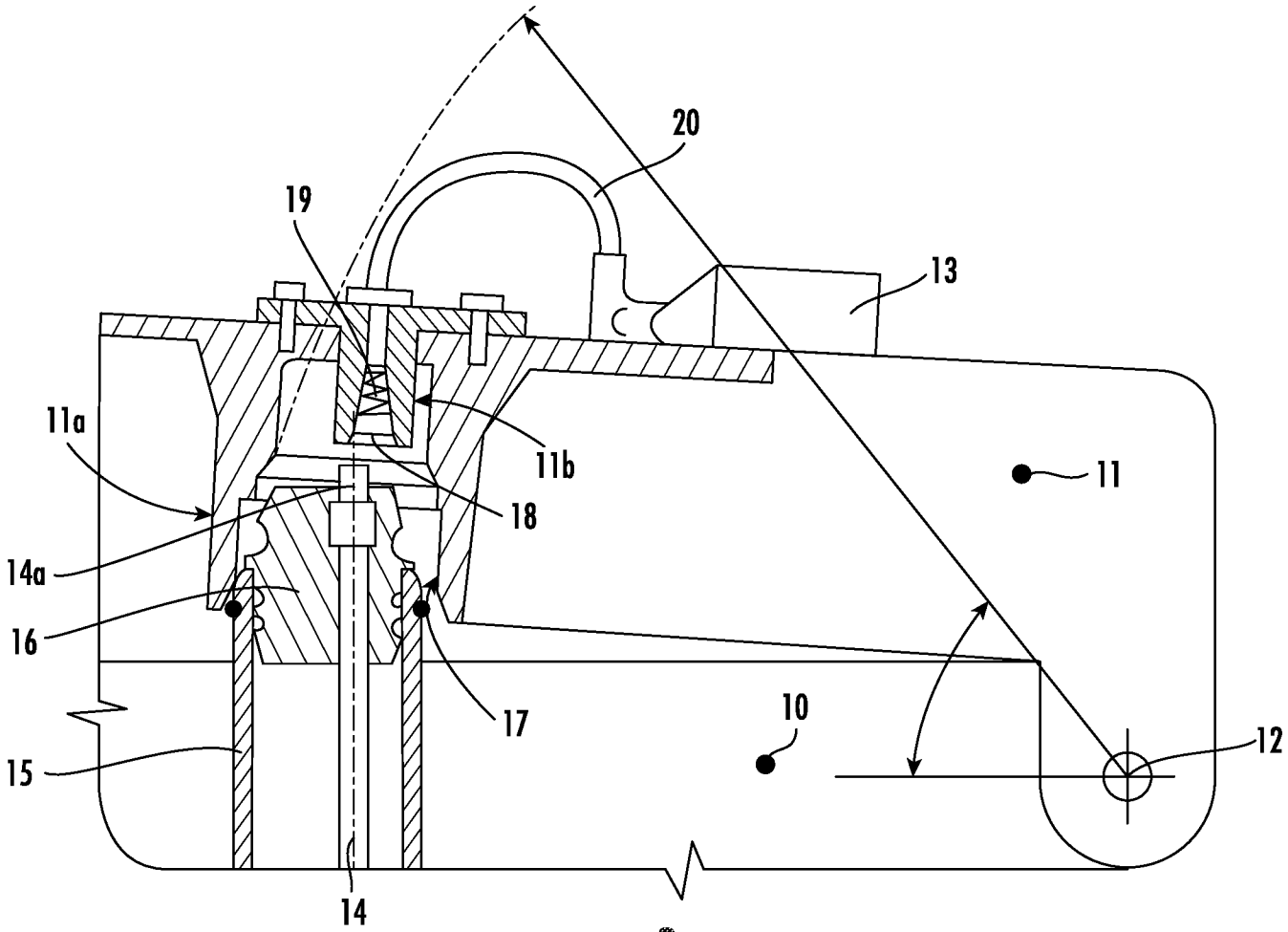
FIG. 2 is an extract of FIG. 1 with a partially opened rocker arm cover.
Figure 3:
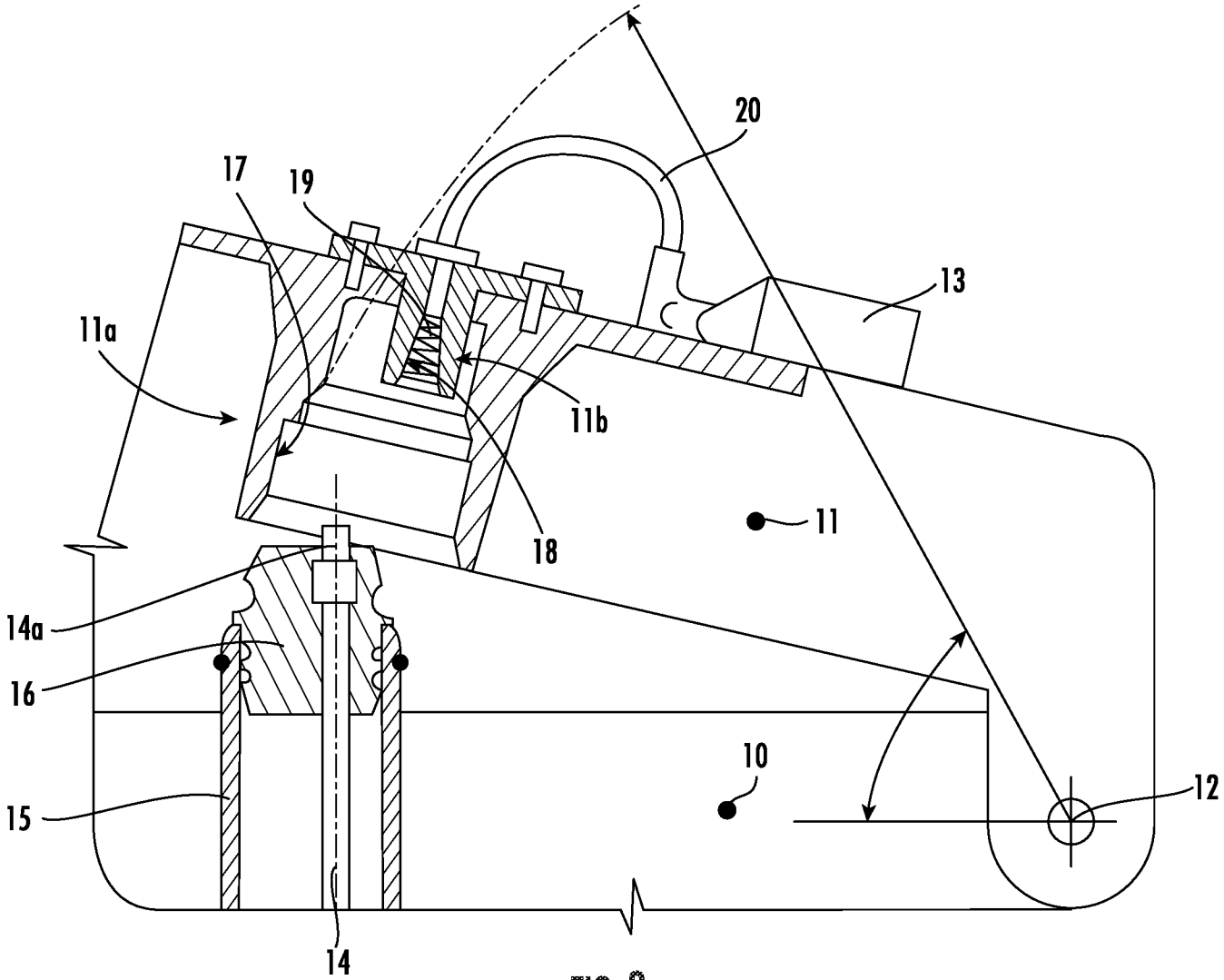
FIG. 3 is an extract of FIG. 1 with the rocker arm cover opened further compared with FIG. 2.

FIGS. 1 to 3 show an extract from an internal combustion engine in the region of a cylinder, namely in the region of a rocker arm box 10 of the respective cylinder, wherein of the rocker arm box 10 an upper portion of the same is shown.

A rocker arm cover 11, which is pivotably mounted on the rocker arm box 10 about an axis of rotation 12, interacts with the respective rocker arm box 10. By pivoting the rocker arm cover 11 to the rocker arm box 10, access to the rocker arm box 10 and to assemblies positioned in the rocker arm box 10, such as for example the rocker arms, can be enabled in order to adjust for example a valve clearance on the gas exchange valves of the respective cylinder.

The rocker arm cover 11 of the respective cylinder carries an ignition coil 13. By way of the ignition coil 13 of the respective cylinder, the spark plug of the respective cylinder can be supplied with electric energy to ignite the respective fuel. In FIGS. 1 and 2 a spark plug extension 14 is shown, which extends emanating from the respective spark plug in the direction of the ignition coil 13, namely through a protective tube 15, which runs between the cylinder head of the cylinder and the rocker arm cover 11 and accordingly extends through the rocker arm box 10.

At an upper end of this protective tube 15, the spark plug extension 14 protrudes with an end 14*a*, wherein via this end 14 of the spark plug extension 14 protruding from the protective tube 15 the electrical contacting of the spark plug with the ignition coil 13 takes place.

From FIGS. 1 to 3 it is evident that the upper end 14*a* of the spark plug extension 14 is guided in a plug 16, which serves for securing the position of the spark plug extension 14 in the protective tube 15. The end 14 of the spark plug extension 14 protrudes relative to the plug 16.

On a first portion 11*a*, the rocker arm cover 11 comprises an introduction aid 17 into which the protective tube 15 or the plug 16 is threaded during the pivoting closure of the rocker arm cover 11.

On a second portion 11*b*, the rocker arm cover 11 furthermore comprises a further introduction aid 18, into which the end 14*a* of the spark plug extension 14 protruding from the protective tube 15 or out of the plug 16 is threaded during the pivoting closure of the rocker arm cover 11. By way of this, an electrical contact between the spark plug extension 14 and the ignition coil 13 of the respective cylinder can then be formed automatically and self-centringly.

According to FIGS. 1 to 3, the second portion 11 with the second introduction aid 18 is arranged within a region delimited by the first portion 11*a* with the introduction aid 17. This is particularly preferred in order to provide the self-centring contacting in the high-voltage path between the spark plug and ignition coil 13.

The second portion 11*b* of the rocker arm cover 11, with which the end 14*a* of the spark plug extension 14 can be contacted, forms a plug contact for the end 14*a* of the spark plug extension 14 protruding from the protective tube 15 or the plug 16, wherein in this plug contact an electrically conductive spring 19 is positioned, which is also arranged in the high-voltage path and accordingly transmits electric current or electric voltage emanating from the ignition coil 13 in the direction of the spark plug.

In the exemplary embodiment shown in FIGS. 1 and 2, a cable 20 extends between the plug contact for the end 14*a* of the spark plug extension 14 and the ignition coil 13. In contrast with this it is possible to position the spark plug 13 directly on the portion 11*b* or the plug contact, wherein such a cable 20 can then be omitted.

The invention allows in internal combustion engines with spark plugs a particularly easy access to assemblies accommodated in the rocker arm box 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An internal combustion engine, comprising: a cylinder crankcase in which a crankshaft is mounted; at least one cylinder bank comprising multiple cylinders, wherein each cylinder comprises: a spark plug for igniting a fuel to be combusted in a respective cylinder; a cylinder head having at least one inlet-side gas exchange valve and at least one exhaust-side gas exchange valve; a rocker arm box configured to accommodate rocker arms of a valve train for the at least one inlet-side gas exchange valve and the at least one exhaust-side gas exchange valve; a rocker arm cover that is pivotable relative to the rocker arm box, wherein the rocker arm cover carries an ignition coil for the spark plug of the respective cylinder, which is contactable with the spark plug via a spark plug extension extending through a protective tube between the cylinder head and the rocker arm box or the rocker arm cover of the respective cylinder; wherein the rocker arm cover comprises: a first portion with a first introduction aid, into which the protective tube or a plug is threaded during pivoting closure of the rocker arm cover; a second portion with a second introduction aid, into which an end of the spark plug extension protruding from the protective tube is threaded during the pivoting closure of the rocker arm cover, to automatically and self-centringly form an electrical contact between the spark plug extension and the ignition coil of the respective cylinder.

2. The internal combustion engine according to claim 1, wherein the end of the spark plug extension protruding from the protective tube is guided in the plug.

3. The internal combustion engine according to claim 2, wherein the end of the spark plug extension protruding from the plug is threaded into the second introduction aid during the pivoting closure of the rocker arm cover.

4. The internal combustion engine according to claim 1, wherein the second portion with the second introduction aid is arranged within a region that is delimited by the first portion with the first introduction aid.

5. The internal combustion engine according to claim 1, wherein the second portion forms an electrical plug contact for the end of the spark plug extension protruding from the protective tube.

6. The internal combustion engine according to claim 5, wherein the electrical plug contact comprises an electrically conductive spring.

* * * * *